US005435108A

United States Patent [19]

Overholt et al.

[11] Patent Number: 5,435,108

[45] Date of Patent: Jul. 25, 1995

[54] INSULATED GARAGE DOOR PANEL

[75] Inventors: Jim Overholt, Glenwood City, Wis.; Orlan Hinrichs, Marco Island, Fla.; Visualdas J. Masiulis, Woodbury, Minn.

[73] Assignee: Clopay Building Products Company, Cincinnati, Ohio

[21] Appl. No.: 162,992

[22] Filed: Dec. 7, 1993

[51] Int. Cl.[6] ..... E06B 3/00

[52] U.S. Cl. ..... 52/309.11; 52/309.9; 160/236

[58] Field of Search ..... 52/309.9, 309.11; 160/201, 236; 49/501

[56] References Cited

U.S. PATENT DOCUMENTS

| | | | |
|---|---|---|---|
| 675,954 | 6/1901 | Kinnear . | |
| 2,174,249 | 9/1939 | Pratt | 160/236 |
| 2,804,136 | 8/1957 | Ternes et al. . | |
| 3,104,699 | 9/1963 | Wolf . | |
| 3,226,284 | 12/1965 | Curtis . | |
| 3,336,713 | 8/1967 | Privas . | |
| 3,413,762 | 12/1968 | Baudé | 49/501 |
| 3,462,897 | 8/1969 | Weinrott . | |
| 3,479,784 | 11/1969 | Massagli . | |
| 3,498,001 | 3/1970 | MacDonald | 49/501 |
| 3,511,301 | 5/1970 | Graham et al. . | |
| 3,555,758 | 1/1971 | Schroter | 52/309.9 |
| 3,608,613 | 9/1971 | Halliwell . | |
| 3,714,747 | 2/1973 | Curran . | |
| 3,772,129 | 11/1973 | Dover | 160/236 |
| 3,885,008 | 5/1975 | Martin . | |
| 3,941,180 | 3/1976 | Thill | 160/201 |
| 3,967,671 | 7/1976 | Stanley | 160/201 |
| 4,008,745 | 2/1977 | Bailey . | |
| 4,028,859 | 6/1977 | Bellagamba . | |
| 4,053,972 | 10/1977 | Kordes | 52/309.11 |
| 4,104,840 | 8/1978 | Heintz et al. | 52/309.9 |
| 4,119,133 | 10/1978 | Wolf . | |
| 4,156,448 | 5/1979 | Bengtsson . | |
| 4,238,544 | 12/1980 | Mullet . | |
| 4,339,487 | 7/1982 | Mullet . | |
| 4,353,187 | 10/1982 | Jenkins, Jr. et al. | 49/501 |
| 4,409,768 | 10/1983 | Boden . | |
| 4,725,471 | 2/1988 | Imhoff | 52/309.11 |
| 4,779,325 | 10/1988 | Mullet . | |
| 4,979,553 | 12/1990 | Lowry et al. . | |

FOREIGN PATENT DOCUMENTS

| | | | |
|---|---|---|---|
| 604937 | 4/1978 | U.S.S.R. | 52/309.9 |

*Primary Examiner*—Carl D. Friedman
*Assistant Examiner*—Laura A. Saladino
*Attorney, Agent, or Firm*—Wood, Herron & Evans

[57] ABSTRACT

An overhead garage door panel has a thin outer metal skin. Along the upper and lower edges of the outer metal skin are top and bottom flanges. The top flange has a rib formed therein which is adapted to mate with a groove formed in the bottom flange of an adjacent corresponding panel. A foam insertion core fills the pan and flanges of the outer skin thereby providing the requisite strength and rigidity in combination with the flanges. The foam core is formed in-situ and a back skin extending between the flanges retains the foam within the panel during the foaming process. Adjacent panels are hinged together and a reinforcing member is glued within each flange to provide a secure mounting attachment for the hinges.

13 Claims, 1 Drawing Sheet

INSULATED GARAGE DOOR PANEL

FIELD OF THE INVENTION

This invention relates to a door panel, and more particularly, to an insulated garage door panel.

BACKGROUND OF THE INVENTION

Garage doors are commonly manufactured with a number of substantially identical panels which are hinged or pivotally connected together. This allows for pivotal relative movement between adjacent door panels when the garage door is moved between a closed generally vertical position and an open generally horizontal position. Such door panels for many years were predominantly constructed of wood. However, wood door panels are both costly to manufacture and heavy in use, resulting in difficulty when opening and closing the garage door.

Recently, sectional garage door panels having an outer metal skin have become popular and have replaced wooden door panels in many applications. Sectional garage door panels which are rolled or formed by thin sheet metal require either internal reinforcing members, typically constructed of wood or metal, or an irregular cross-section, such as a relief or design or channel shape, to provide the panels with the requisite strength and rigidity. Center and end stiles are often provided within the sheet metal door panel for the required reinforcement.

However, the reinforcing stiles tend to defeat one of the prime advantages of the thin sheet metal door panels; namely, the stiles add additional weight. Therefore, a garage door formed from door panels having reinforcing stiles is difficult and heavy to operate. Additionally, metal door panels even with the reinforcing stiles often do not provide sufficient strength and rigidity for specific garage door applications in which the door is significantly wide and exposed to relatively high velocity winds.

Thin sheet metal door panels are commonly formed having a channel cross-section configuration. However, to provide the needed strength and rigidity, the channel section of the sheet metal door panel is significantly thick, thereby increasing the garage door weight. Such channel-shaped door panels are designed for the purpose of increasing the strength of the door, but these channel-shaped panels having relatively thick metal skins are not adapted for many garage door applications requiring both light weight and increased strength.

To add both increased strength and thermal insulation protection, a foam core is often included in the channel door panels previously described. The foam insulation core increases the resistance of the thin metal skin door panel to deflect and warp due to impacting wind or other tensile loads.

The foam insulation core within the sheet metal door panel can provide required strength and rigidity without the increased weight associated with wooden or metal stiles or other reinforcing members. The problem with using the foam insulation core to provide the strength and rigidity in a thin metal skin door panel is that the foam insulation core must be of substantial thickness throughout the cross-section of the door panel. The added thickness of foam insulation requires added production and material costs when fabricating such a door panel.

As evidenced by the above background, there is an existing need for a metal skin garage door panel which provides the required strength and rigidity to withstand the wind and structural loads associated with many garage door applications while remaining lightweight. Furthermore, the garage door panel must be easily and economically manufactured with a minimum of component parts while providing the identified physical attributes.

SUMMARY OF THE INVENTION

This invention is directed to an improved garage door panel which is constructed primarily of a thin sheet metal skin around a foam insulation core. Integrally formed with the sheet metal outer skin is a flange extending across the top and bottom edge of each door panel. Each flange has a generally box channel profile and extends rearwardly from the front face of the door panel. Each flange consists essentially of three integrally formed lips or faces which include an outer lip generally perpendicular to the front face of the door panel, a back lip generally parallel to the front face and an inner lip angularly extending toward the face of the door panel from the back lip.

The foam insulation core fills the internal volume of each flange defined by the three faces or lips of the flange. A thinner section of foam insulation extending between the flanges is formed on the back face of the outer metal skin panel. The foam insulation core of the door panel can be formed in-situ or constructed of preformed foam members. To contain the foam while being formed in-situ, a back face is optionally included between the flanges of the present invention door panel. The back face consists of a sheet of plastic film, paper, steel, foil, or Kraft paper which is provided to contain the foam being formed in-situ within the door panel pan. The back face adds structural composite strength to the door panel. A generally hook shaped channel is provided on the most forward edge of the inner lip of each flange for retaining the back skin between the flanges. The upper and lower edges of the back skin are inserted between generally parallel legs of the hook shaped channel to secure the back skin in place.

The top and bottom flanges, being filled with foam insulation, provide the requisite strength and rigidity to the sheet metal door panel. The strength and rigidity of the foam filled flanges allow for a much thinner layer of foam insulation core against the back face of the outer skin of the door panel between the flanges. Because the door panel derives its strength and rigidity from the foam filled flanges, there is no need for reinforcing the panel with stiles or wooden frame members. Furthermore, the reduced thickness of the foam insulation pan between the top and bottom flanges provides sufficient thermal insulation for the garage door panel without adding excessive weight or unneeded structure to the door panel.

A rib and groove interface is provided at the intersection of adjacent door panels. A rib is formed on the outer lip of each top flange which is adapted to mate with a groove formed in the outer lip of each bottom flange. The rib and groove interface between adjacent door panels provides weather protection for the garage door in that both wind and water impinging upon the front face of the garage door are inhibited from flowing between adjacent panels. Furthermore, the rib and groove interface provides for the registration of adjacent door panels and a homogenous interface which offers a reference for alignment of the respective door panels within the garage door.

Adjacent garage door panels are pivotally interconnected by a hinge allowing the garage door to be selectively moved between the generally vertical closed position and the generally horizontal open position. The hinge is secured to the back lip of each bottom flange and each top flange on adjacent door panels. The hinge is conventionally secured by screws into the respective flanges; however, because the skin of the door panels is thin and filled with a foam insulation core, a reinforcing member is provided within each flange for the secure attachment of the hinge. A generally U-shaped channel is glued or otherwise secured within the flange against the back lip prior to the installation or in-situ forming of the foam insulation core. Therefore, the screws securing the hinge are driven through the thin metal skin of the back lip of each flange and into the reinforcing member for a secure attachment.

The above features and advantages of the present invention will be better understood in reference to the accompanying figures and detailed description.

BRIEF DESCRIPTION OF THE DRAWINGS

Reference is now made to the accompanying figures from which the novel features and advantages of the present invention will be apparent.

DETAILED DESCRIPTION OF THE INVENTION

By way of illustrating and providing a more complete appreciation of the present invention and many of the attendant advantages thereof, the following detailed description is given concerning the novel garage door panel and methods of production and use thereof.

Figure 1:
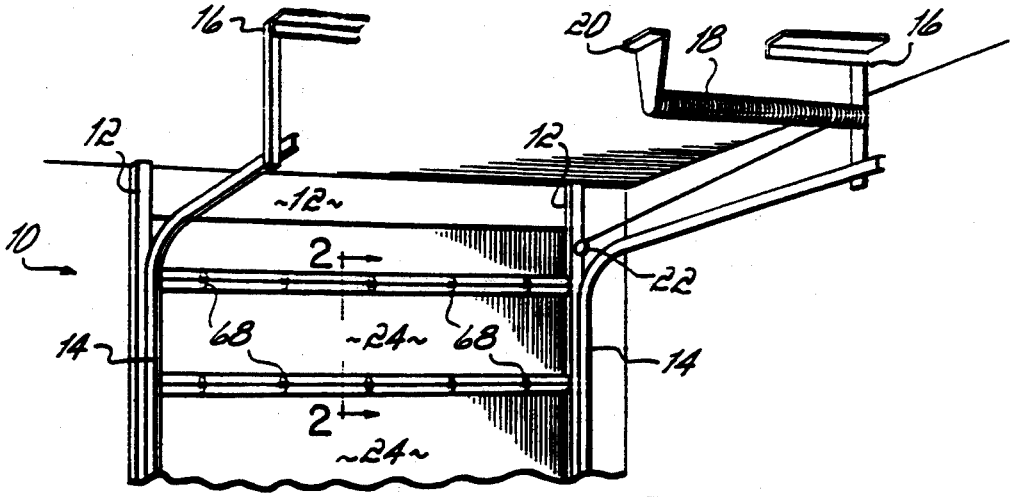
FIG. 1 is a perspective view of a garage door having door panels according to the present invention.

A garage door 10 in a closed generally vertical position is shown in FIG. 1. The garage door 10 is mounted to a garage door frame 12 between a pair of generally parallel tracks 14 extending along each lateral edge of the garage door 10. The tracks 14 are secured with mounting structure 16 to the garage in order to enable the garage door 10 to be slidably moved between the closed position and a generally horizontal open position (not shown). To assist the movement of the garage door 10 between the closed and open positions, a torsion spring 18 is mounted between a bracket 20 and the garage door track mounting structure 16 and connected to the garage door 10 with a pulley 22. It will be appreciated by one of ordinary skill in the art that other acceptable means for counterbalancing the door 10 such as extension springs or counterbalance weights can be employed with a garage door 10 according to this invention.

Figure 2:
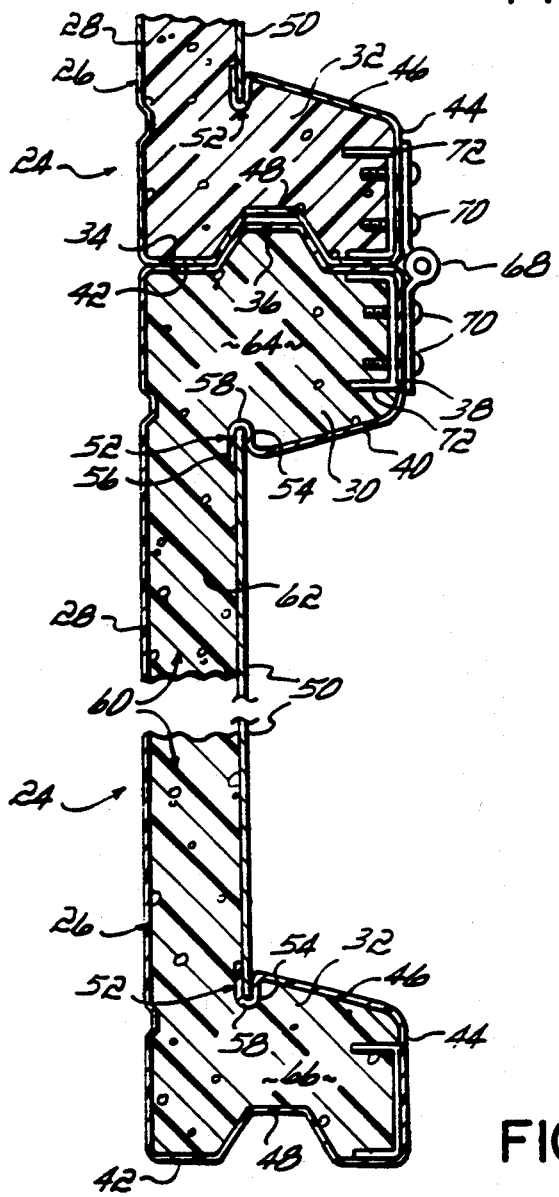
FIG. 2 is a cross-sectional view taken along line 2—2 of FIG. 1 showing the door panels.

The garage door 10 includes a number of serially aligned garage door panels 24. As shown in FIG. 2, each garage door panel 24 of the present invention includes a thin metal outer skin 26 with a front face 28. Collectively, the front faces of all the panels 24 form the front of the garage door 10. Each panel 24 has a top flange 30 formed along an upper edge thereof and a bottom flange 32 formed along a lower edge thereof. Each top flange 30 is designed to mate with the bottom flange 32 of an adjacent garage door panel 24.

The top flange 30 has an outer lip 34 integrally formed with the front face 28 of the outer skin 26. A rib 36, trapezoidal in shape, projects from the top flange outer lip 34. A back lip 38 is generally parallel to the front face 28 of the outer skin 26 and is formed with the outer lip 34 and an inner lip 40 angularly projecting from the back lip 38 toward the front face 28.

The bottom flange 32 also includes an outer lip 42 integrally formed with the outer skin front face 28 and a back lip 44 joining the outer lip 42 and an inner lip 46 which angularly extends toward the front face 28. Formed in the bottom flange outer lip 42 is a generally trapezoidal shaped groove 48 which is adapted to mate with the rib 36 extending from the outer lip 34 of the top flange 30 of an adjacent door panel 24.

Extending between the top flange 30 and bottom flange 32 on the back side of the door panel 24 is a back skin 50. A hook shaped channel 52 is formed at the free end of both the top and bottom flange inner lips 40, 46. The channel 52 has a short leg 54 joined to a long leg 56 by an arcuate crown portion 58, The top and bottom edge of the back skin 50 is received within the hook shaped channels 52 of the top and bottom flanges 30, 32, respectively, such that the back skin 50 is interposed between the short leg 54 and the long leg 56.

A foam insulation core 60 fills the door panel 24 in the preferred embodiment of the present invention. The foam insulation core 60 has a narrowed pan region 62 extending between enlarged top and bottom hems 64, 66. The top and bottom hems fill the top and bottom flanges 30, 32, respectively, of the door panel 24; whereas, the narrowed pan region 62 of the foam insulation core 60 is sandwiched between the door panel outer skin front face 28 and the back skin 50.

Adjacent door panels of the present invention are pivotally interconnected as by a hinge 68 or other suitable mechanism. The hinge 68 is connected on the back lip 38, 44 of adjacent top and bottom flanges 30, 32 of adjacent door panels 24. The hinge 68 is connected with screws 70 or other suitable fasteners through the thin skin of the back lip 38, 44 and into a generally U-shaped reinforcing member 72 provided within each flange 30, 32. The U-shaped reinforcing member 72 is positioned to abut against the back lip 38, 44 within each flange 30, 31 and thereby provide a secure attachment point for the screws 70 joining the hinge 68 to the flange 30, 32.

In the preferred embodiment of the present invention, the metal outer skin 26 including the top and bottom flanges 30, 32 is fabricated from roll formed hot dipped galvanized steel with an epoxy primer and a polyester top coat and is approximately 0.009 inches to 0.016 inches in thickness. The garage door panel with such a relatively thin outer skin is of lighter weight than previously known garage door panels; however, due to the relative thinness of the outer skin 26, the reinforcing member 72, being preferably about 0.4 inches thick, is required within each flange 30, 32 for a secure attachment of the hinge. The reinforcing member 72 is preferably attached with adhesive within each flange 30, 32 to the rear side of each back lip 38, 44 prior to adding the foam insulation core 60 to the outer skin 26.

The foam insulation core 60 is preferably formed in-situ by mixing the required components within the pan and flange portions of the door panel 24 and allowing the foam to expand and thereby fill the respective portions of the door panel 24. The back skin 50 which is preferably made from plastic film, paper film, Kraft paper, or thin sheet metal such as steel or foil, is helpful when forming the foam in-situ to retain the foam within the pan and flanges of the door panel 24 during the foaming process. Additionally, the back skin 50 preferably adds structural strength to the door panel 24. Alternatively, the foam insulation core 60 can be constructed of pre-formed components which are designed and sized to fill the garage door panel of the present invention. The hook shaped channels 52 extending along the inner lip 38, 44 of each flange 30, 32 retain the back skin 50 and conceal the raw edge along the top and bottom portions of the back skin. The foam insulation core is preferably polyurethane.

The coupling of adjacent door panels 24 with the rib and groove configuration in the preferred embodiment of the present invention aids in the registration and alignment of adjacent door panels 24. Additionally, the rib and groove configuration offers a weather protection feature to inhibit wind and water from broaching between adjacent door panels 24. The protection from both wind and water could be enhanced in the present invention by the inclusion of a foam weather seal (not shown) within each groove.

From the above disclosure of the general principles of the present invention and the preceding detailed description of the preferred embodiment, those skilled in the art will readily comprehend the various modifications to which the present invention is susceptible. Therefore, we desire to be limited only by the scope of the following claims and equivalents thereof.

What is claimed is:

1. A garage door panel comprising:

an outer metal skin having a back face and first and second spaced edges;

first and second integrally formed flanges extending along said first and second edges, respectively, said first and second flanges adapted to mate with second and first flanges, respectively, of adjacent corresponding door panels, said first and second flanges each comprising an outer lid joined to said outer skin, a back lid joined to said outer lip, and an inner lip joined to said back lip, said inner lip projecting from said back lip and toward said outer skin to provide enhanced strength to the garage door panel;

a pivotal connector for joining adjacent corresponding door panels;

said first and second flanges having means for securing said pivotal connector for joining adjacent door panels; and a foam insulation core having a front face and first and second hems, said front face adjoining said outer skin back face and said first and second hems being interposed within first and second flanges, respectively.

2. The garage door panel of claim 1 further comprising:

a back skin covering a back face of said foam core, said back skin having spaced edges and extending between said first and second flanges; and said first and second flanges having means for receiving said spaced edges of said back skin.

3. The garage door panel of claim 2 wherein said back skin is fabricated from one of a group consisting of paper, plastic film and metal.

4. The garage door panel of claim 2 wherein said receiving means is a hook shaped channel having a long leg and a short leg, each said back skin edge being inserted between said long and short legs and said long leg being interposed between said back skin and said insulation core.

5. The garage door panel of claim 1 further comprising:

a groove formed in said outer lip of said first flange; and a rib formed in said outer lip of said second flange, said rib being adapted to mate with said groove when said first and second flanges of adjacent garage door panels are coupled.

6. The garage door panel of claim 1 wherein said securing means comprises a reinforcing member interposed within each said first and second flange on each said back lip.

7. The garage door panel of claim 1 wherein said first and second flanges are each single ply.

8. The garage door panel of claim 1 wherein said outer skin is fabricated from steel.

9. The garage door panel of claim I wherein said foam insulation core is formed in-situ.

10. The garage door panel of claim 1 wherein said securing means is a reinforcing member interposed within each said first and second flange.

11. The garage door panel of claim 1 wherein said foam insulation core comprises a pan region facing said outer skin back face and extending between said first and second hems, said pan region being substantially thinner in cross-section than said first and second hems of said foam insulation core.

12. A garage door panel comprising:

an outer metal skin having a back face and first and second spaced edges;

first and second integrally formed flanges extending along said first and second edges, respectively, each said first and second flange having an outer lip joined to said outer skin, a back lip joined to said outer lip and an inner lip joined to said back lip, said inner lid projecting from said back lid and toward said outer skin to provide enhanced strength to the garage door panel, a groove formed in said outer lip of said first flange and a rib adapted to mate with said groove and formed in said outer lip of said second flange;

a reinforcing member interposed within each said first and second flange, said reinforcing member facilitating the secure attachment of a pivotal connector for joining adjacent corresponding door panels; and a foam insulation core having a pan region and first and second hems, said pan region facing said outer skin back face and extending between said first and second hems, said first and second hems being interposed within said first and second flanges, respectively, and said pan region being substantially thinner in cross-section than said first and second hems of said foam insulation core.

13. A garage door comprising:

a plurality of garage door panels, each said door panel comprising an outer metal skin having a back face and first and second integrally formed spaced flanges, said first and second flanges adapted to mate with second and first flanges, respectively, of an adjacent corresponding garage door panel, said first and second flanges each comprising an outer lid joined to said outer skin, a back lip joined to said outer lip, and an inner lip joined to said back lip, said inner lip projecting from said back lip and toward said outer skin to provide enhanced strength to the garage door panel, each said door panel having a foam insulation core with a front face and first and second hems, said front face of said foam adjoining said back face of said door panel and said first and second hems being interposed within said first and second flanges, respectively;

means for pivotally coupling each said first flange to said second flange of said adjacent door panel; and means for securing said coupling means, said securing means being on each said first and second flange.

* * * * *

UNITED STATES PATENT AND TRADEMARK OFFICE

CERTIFICATE OF CORRECTION

PATENT NO. : 5,435,108

DATED : July 25, 1995

INVENTOR(S) : Overholt et al.

It is certified that error appears in the above-indentified patent and that said Letters Patent is hereby corrected as shown below:

Col. 4, line 21, "58," should be -- 58. --

Col. 5, line 39, "lid" should be -- lip --.

Col. 5, line 40, "lid" should be -- lip --.

Col. 6, line 38, "lid" (2 occurrences) should be -- lip --.

Col. 6, line 65, "lid" should be -- lip --.

Signed and Sealed this

Thirty-first Day of October 1995

*Attest:*

*Attesting Officer*

Bruce Lehman

BRUCE LEHMAN

*Commissioner of Patents and Trademarks*